US008529250B2

(12) United States Patent
Schwartz

(10) Patent No.: US 8,529,250 B2
(45) Date of Patent: Sep. 10, 2013

(54) METHOD AND CONTINUOUS FURNACE FOR HEATING WORKPIECES

(75) Inventor: Rolf-Josef Schwartz, Simmerath (DE)

(73) Assignee: Eva Schwartz, Aachen (DE)

( * ) Notice: Subject to any disclaimer, the term of this patent is extended or adjusted under 35 U.S.C. 154(b) by 1133 days.

(21) Appl. No.: 12/422,611

(22) Filed: Apr. 13, 2009

(65) Prior Publication Data

US 2009/0263758 A1 Oct. 22, 2009

(30) Foreign Application Priority Data

Apr. 17, 2008 (DE) ..... 10 2008 019 471
Nov. 5, 2008 (DE) ..... 10 2008 055 980

(51) Int. Cl.
*F27D 3/00* (2006.01)
*F27B 9/00* (2006.01)

(52) U.S. Cl.
USPC ..... 432/11; 432/246; 432/8; 432/9; 432/86; 432/87; 432/121; 432/128; 432/133; 432/135; 432/136; 432/143

(58) Field of Classification Search
USPC ..... 432/128, 133, 135, 136, 143, 8, 9, 432/11, 86, 87, 121, 246
See application file for complete search history.

(56) References Cited

U.S. PATENT DOCUMENTS 4,013,403 A * 3/1977 Petrus ..... 432/239
4,160,891 A * 7/1979 Scheffler ..... 219/658
4,340,358 A * 7/1982 Bossetti ..... 432/11
4,554,437 A * 11/1985 Wagner et al. ..... 219/388
5,201,401 A * 4/1993 Haderer et al. ..... 198/463.3
5,443,383 A * 8/1995 Kuehn ..... 432/122
6,524,404 B2 * 2/2003 Gehringhoff et al. ..... 148/320
7,340,992 B1 * 3/2008 Wolfe et al. ..... 99/386
7,578,894 B2 * 8/2009 Reinhold et al. ..... 148/639
2001/0051323 A1 * 12/2001 Nishimura ..... 432/11
2004/0112485 A1 * 6/2004 Reinhold et al. ..... 148/639
2006/0071375 A1 * 4/2006 Arai et al. ..... 266/143
2007/0012307 A1 * 1/2007 Wiker et al. ..... 126/21 A
2009/0320968 A1 * 12/2009 Boeke et al. ..... 148/546
2011/0214786 A1 * 9/2011 Loecker et al. ..... 148/559

OTHER PUBLICATIONS 44727-c1-1—Middleby Marshall users Manual 2001.*

* cited by examiner

*Primary Examiner* — Kang Hu
*Assistant Examiner* — Nathaniel Herzfeld
(74) *Attorney, Agent, or Firm* — International IP Law Group, PLLC

(57) ABSTRACT

There is provided a system and method for heating at least one workpiece in a furnace by which the workpiece is heated by heating facilities. An exemplary method comprises heating a complete workpiece with the heating facilities. The exemplary method also comprises moving the workpiece out of the furnace such that a first portion of the workpiece is still inside the furnace while a second portion of the workpiece is outside the furnace and holding the workpiece at this position for a predetermined time period. Finally, the exemplary method comprises moving the complete workpiece out of the furnace.

11 Claims, 14 Drawing Sheets

METHOD AND CONTINUOUS FURNACE FOR HEATING WORKPIECES

CROSS REFERENCE TO RELATED APPLICATIONS

This application claims priority to German (DE) Patent Application No. 10 2008 019 471.9, filed on Apr. 17, 2008, the contents of which are incorporated by reference as if set forth in their entirety herein, and to German (DE) Patent Application No. 10 2008 055 980.6-24, filed on Nov. 5, 2008, the contents of which are incorporated by reference as if set forth in their entirety herein.

BACKGROUND

In the field of the manufacture and treatment of moulded parts, it is customary to specifically manufacture moulded parts having the desired material properties. In the automotive industry for example, parts such as transverse links, B-columns or bumpers for motor vehicles are hardened by being heated completely and subsequently quenched. For hardening, this can be followed by a tempering process. However, for some automotive engineering applications it is an advantage when moulded parts have different material properties in different portions. It could, for example, be required that a part has high strength in one portion but should in comparison have higher ductility in another portion.

In order to realize moulded parts which can satisfy various strains and stresses in different portions, parts with differing properties can, for example, be joined. Further, parts can be strengthened by additional sheet metal. Another option is the soft annealing of the appropriate portions of previously completely hardened moulded parts in order to achieve portions with higher ductility. This, however, leads to changes in the form of the part which are not tolerable.

Additionally, there is the option to treat moulded parts during manufacture so that portions with different material properties are generated. In this case, portions with different structures develop and various state of the art technological processes and facilities are known for the manufacture of moulded parts with at least two structural areas. For example, the use of induction current to heat parts is known. In this case, however, high costs and non-uniform heating are to be expected.

Further, European patent application EP 1 426 454 A1 discloses a process to manufacture a moulded part with at least two structural portions of differing ductility and a continuous furnace to carry out the process. In this case, a semi-finished product in the form of a blank or pre-formed part which is to be heated is transported through a continuous furnace comprising two zones arranged side by side in which different temperature levels can be adjusted. The part in the furnace is thus heated to two different temperatures and subsequently subjected to a hot forming process and/or a hardening process. The portion of the part which is subjected to higher heat thereby develops a more ductile structure while the portion subjected to lower heat develops a strong or high-strength structure.

The German utility model DE 200 14 361 U1 describes a process to manufacture a B-column with differing structural areas by which the B-column is heated in a furnace and thus austenitized and subsequently hardened in a cooled tool. When heating in a furnace, large portions of the used blank and/or semifinished product are insulated against the effects of temperature so that no martensitic material structure with high strengths can develop in the shielded portions. However, this process is unsafe because in the case of operational malfunction, heat can penetrate the shielded portions and thus also heat these portions to hardening temperature.

In particular, the known processes are particularly unsuitable for mass operation with a cycle time of approximately 15 seconds and for process reliability as is required for the manufacture of automotive vehicles because they cannot permanently ensure the specified hardening profile in the part.

SUMMARY OF THE INVENTION

An exemplary embodiment of the present invention relates to a method for heating at least one workpiece in a furnace by which the workpiece is heated by heating facilities. In addition, an exemplary embodiment of the present invention relates to a corresponding furnace to carry out the process.

An exemplary embodiment of the present invention may provide a method for heating parts which in subsequent process steps enables the development of portions of the part with different material properties. Moreover, a facility to carry out the process may additionally be provided.

A method according to an exemplary embodiment of the present invention serves to heat at least one workpiece in a furnace whereby the workpiece is heated by heating facilities. After heating a complete workpiece by the heating facilities in a first step, the workpiece is moved in accordance with an exemplary embodiment of the present invention so far out of the furnace that a first portion of the workpiece is still inside the furnace while a second portion of the workpiece is outside the furnace. The workpiece is kept at this position for a predetermined time period and the entire workpiece is subsequently moved out of the furnace.

In an exemplary embodiment of the invention, at least one workpiece is heated in a continuous furnace and the workpiece thereby moved through the continuous furnace by a transportation device. After the front side in the direction of travel of a workpiece has passed through the heating zone of the continuous furnace, the workpiece is moved so far out of the heating zone of the continuous furnace by the transportation device that a first portion of the workpiece is still inside the heating zone while a second portion of the workpiece is already outside the heating zone. The movement of the transportation device is interrupted at this position of the workpiece for a predetermined time period and subsequently the entire workpiece is again moved out of the heating zone of the continuous furnace by the transportation device.

In an exemplary embodiment of the invention, the first portion of the workpiece is heated by the process according to the invention to a temperature $T_1$ which is below the hardening temperature of the material of the workpiece while the second portion of the workpiece is heated to a temperature $T_2$ which corresponds to the hardening temperature of the material of the workpiece. Thereby when the front side in transportation direction of the workpiece is moved through the heating zone of the continuous furnace, the entire workpiece can be heated to a temperature which is below the hardening temperature of the material of the workpiece while the second portion of the workpiece inside the heating zone is further heated to a temperature $T_2$ which corresponds to the hardening temperature of the material of the workpiece when the first portion of the workpiece is outside the heating zone.

Preferably, the workpiece is moved through an entry opening into the continuous furnace after a cover has temporarily opened this entry opening and the workpiece is moved out of the continuous furnace through an exit opening after a cover has temporarily opened this exit opening. The cycle times of the covers of the entry and exit openings are suitably adjusted to the cycle times of the transportation device.

It can further be provided that the cover of the exit opening only partly opens this exit opening in order to move the second portion of the workpiece out of the continuous furnace and the cover of the exit opening then opens the exit opening more than before, in order to subsequently move the workpiece completely out of the continuous furnace whereby the varying degrees of opening of the cover of the exit opening are also adjusted to the cycle times of the transportation device. Opening the cover only partly can reduce heat loss.

In an exemplary embodiment of the invention, at least two workpieces next to each other are simultaneously moved through the continuous furnace by means of at least one transportation device and are thereby heated by heating facilities in a heating zone. In this way, the throughput of the furnace can be increased. In particular in order to adjust the cycle times of the furnace to the capacities of downstream stations, it can be provided that the transportation movement of at least a first workpiece is interrupted while at least a second workpiece is moved by means of the transportation device so far out of the heating zone of the continuous furnace that a first portion of the workpiece is still inside the heating zone while a second portion of the workpiece is already outside the heating zone. At this position, the transportation movement of the at least one second workpiece is interrupted for a predetermined time period until it is moved out of the heating zone of the continuous furnace. Subsequently or parallel to this, the transportation movement of the at least one first workpiece and a movement of the at least one first workpiece so far out of the heating zone of the continuous furnace is resumed so that a first portion of this workpiece is still inside the heating zone while a second portion of this workpiece is already outside the heating zone. The transportation movement of the at least one first workpiece is interrupted at this position for a predetermined time period and a movement of the at least one first workpiece out of the heating zone of the continuous furnace takes place.

An interruption of the transportation movement of individual workpieces can, for example, be achieved by moving each of the workpieces through the continuous furnace using a separate transportation device and the interruption of the transportation movement of the at least one first workpiece is achieved by interrupting the movement of the corresponding transportation device while the resumption of the transportation movement of the at least one first workpiece is achieved by resuming the movement of the corresponding transportation device. In an alternative embodiment, all workpieces are moved through the continuous furnace by means of a common transportation device and the interruption of the transportation movement of the at least one first workpiece is achieved by disconnecting the at least one first workpiece from the transportation device while the resumption of the transportation movement of the at least one first workpiece is achieved by connecting the at least one first workpiece to the transportation device.

To enable a disconnection of individual workpieces from the transportation device, the transportation facility can, for example, be provided as a roller conveyor on which the workpieces move next to each other simultaneously through the heating zone of the continuous furnace. The disconnection of at least a first workpiece from the roller conveyor can then be achieved by lifting the workpiece to a position in which the workpiece does not have any contact to the roller conveyor while the connection of at least a first workpiece to the roller conveyor is achieved by lowering the workpiece to a position in which the workpiece is again in contact with the roller conveyor and is moved by the same in the direction of travel. This lifting and lowering of a workpiece can be achieved by one or more push rods which are arranged beneath the workpieces and move up and down in cycle time. The upward movement of at least one push rod can result in the workpiece being lifted from below while the downward movement of at least one push rod results in the lowering of the workpiece. This movement of the push rods is suitably controlled by a control device.

The invention further includes a continuous furnace to heat at least one workpiece in which the workpiece is movable by a transportation device through the continuous furnace and is thereby heatable in a heating zone by means of heating facilities. In accordance with an exemplary embodiment of the present invention, the transportation device is equipped with facilities to move the workpiece so far out of the heating zone of the continuous furnace that a first portion of the workpiece is still inside the heating zone while a second portion of the workpiece is already outside the heating zone. At this position of the workpiece, the movement of the transportation device is interruptable for a predetermined time period which is controlled by a control device.

Preferably, the continuous furnace is equipped with an entry opening and an exit opening each of which can be temporarily closed by a cover whereby the cycle times of the opening of the entry and exit openings are adjusted to the cycle times of the transportation device. The transportation device can be a roller conveyor on which a workpiece is moved through the continuous furnace. Preferably, the cover of the exit opening enables varying degrees of opening of the exit opening in order to be able to open the cover only as far as is necessary for the workpiece in question at one point in time. This permits the avoidance of unnecessary heat loss from the furnace.

In an exemplary embodiment of the invention, several workpieces next to each other are simultaneously movable by means of at least one transportation device through the continuous furnace and are thereby heatable in a heating zone by heating facilities. At least one transportation device which is equipped with facilites can thereby be provided which enables the movement of a workpiece so far out of the heating zone of the continuous furnace that a first portion of the workpiece in question is still inside the heating zone while a second portion of the workpiece in question is already outside the heating zone. At this position of the workpiece in question, the movement of the at least one transportation device is interruptable for a predetermined time period and the continuous furnace is further equipped with facilities to temporarily interrupt the transportation movement of workpieces while travelling through the furnace.

Thereby, for example, a separate transportation device can be provided for each of the workpieces with which the workpiece in question is movable through the continuous furnace whereby the transportation devices in question are individually controllable and the temporary interruption of the transportation movement of a workpiece can be achieved by the temporary interruption of the movement of the corresponding transportation device.

Alternatively, a common transportation device can be provided for the transportation of all the workpieces durch the continuous furnace and the continuous furnace is equipped with facilities to temporarily disconnect individual workpieces from the transportation device. In this case, the transportation device can, for example, be a roller conveyor on which the workpieces are movable through the heating zone of the continuous furnace and the temporary disconnection of a workpiece from the roller conveyor is achieved by lifting the workpiece to a position in which the workpiece does not have any contact to the roller conveyor. The connection of a workpiece to the roller conveyor is then achieved by lowering the workpiece to a position in which the workpiece is again in contact with the roller conveyor and is movable by this in the direction of travel. To lift and lower a workpiece, one or more push rods which are beneath the workpieces can be provided whereby the push rods are designed for upward and downward movement in cycle time and a control device is provided which controls this upward and downward movement of the push rods.

Due to the heating according to an exemplary embodiment of the present invention, parts with different temperature zones and therefore also different structures are manufacturable whereby this process is rapid and permits the realization of short cycle times. Further, an exemplary embodiment of the present invention may provide a secure process which does not lead to undesired changes in the form of the part and always permits the reliable adjustment of the structure.

For example, sheet metal workpieces can be heated homogenously in the furnace to austenite temperature and subsequently moved out of the furnace door with the desired end. In the ambient temperature, this sheet metal part cools down slowly and hereby develops perlite and ferrite structures while the part which is still in the furnace continues to reside in austenit structure. After ca. 15-25 seconds, the sheet metal is rapidly conveyed out of the furnace and preferably formed as well as cooled down rapidly in a water-cooled extrusion die. During this cooling, martensitic steel develops from the hot austenite and soft and plastically deformable perlite steel with ferrite steel develops in the cooler portion of the sheet metal.

Several parts next to each other can thereby be moved simultaneously through a furnace which thus increases the throughput of such a furnace as opposed to furnaces in which parts are moved individually one after the other through a furnace and are thereby heated. As, however, process stations such as presses which are downstream from the heating of the parts in contrast often have limited capacities, it is possible in particular by an embodiment of the invention by which a temporary interruption of the movement of individual parts is achieved to adjust the output of a continuous furnace to the given capacities of the downstream stations. The throughput of a furnace can therefore be increased by simultaneously heating several parts while the individual output of heated parts can be adjusted to the availability of the downstream stations. Parts can thus be discharged from the furnace at the cycle time at which they can be processed by the downstream stations. If the capacities of the downstream stations change, the output cycle time of the furnace can be adjusted.

BRIEF DESCRIPTION OF THE DRAWINGS

Further advantages, special features and suitable further developments of an exemplary embodiment of the present invention may be ascertained from the figures.

DETAILED DESCRIPTION OF SPECIFIC EMBODIMENTS

Figure 1:
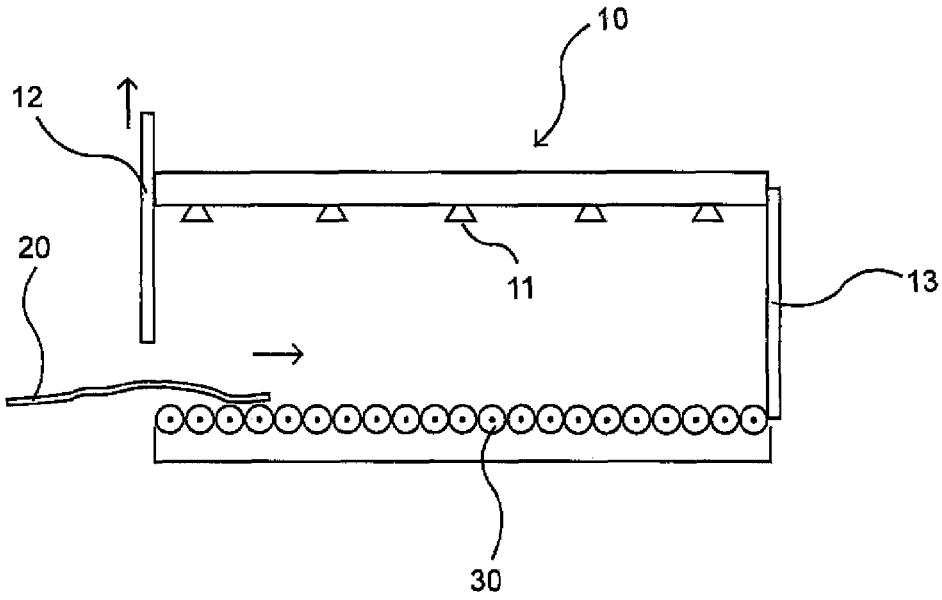
FIG. 1 is a cut-away view of a furnace showing the process step of introducing a workpiece into a continuous furnace in accordance with an exemplary embodiment of the present invention.

FIG. 1 illustrates an exemplary embodiment of a continuous furnace 10 according to an exemplary embodiment of the present invention which is equipped with a furnace housing in which a roller conveyor is preferably provided as the transportation device 30 for workpieces 20. The workpieces 20 are placed on the roller conveyor and moved by driven rollers through the continuous furnace 10. However, any other transportation devices can be provided. For example, it is possible to provide a transportation device in which workpieces are hung up and are moved through the furnace while hanging.

The workpieces can be any parts where the two opposing end portions should have different material properties. For example, this could be a B-column or a moulded part for the B-column of a motor vehicle by which the base of the B-column should be comparatively ductile while the rest of the part should be of higher strength. In an exemplary embodiment of the process according to the invention it is provided that a workpiece 20 is introduced into the furnace 10 so that the end portion in which a higher ductility than in other portions should be achieved is at the front in the direction of travel of the workpiece. If the process is carried out in a furnace in which a workpiece is removed from the same opening as with which it was introduced into the furnace, then the case is exactly the opposite. Then that end portion in which a higher ductility should be achieved than in other portions should be to the back from the direction of travel of the workpiece when the workpiece is moved into the furnace.

The housing of the furnace 10 is preferably closed and is just equipped with an entry and an exit opening through which the workpieces 20 can be introduced into the furnace on the one side and can be moved out of the same on the other side. Each opening is closable by means of covers 12 and 13. The covers can, for example, be furnace slides which can be pushed in front of the openings in order to close or open these temporarily. The furnace slides are moved by a controllable drive.

Preferably, the covers 12 and 13 move upward to open the furnace opening in question so that, for example, a workpiece on a roller conveyor can be moved into the furnace. The workpieces 20 can also be placed on the transportation device manually or by robots. Alternatively, the workpieces can be transported on another transportation device to the furnace 10 and transferred to the transportation device 30 of the furnace.

The covers 12 and 13 can also open the furnace opening in question by moving sideways or the covers move downward in order to open the upper portion of an opening. This is, for example, an advantage when a conveyor moving hanging workpieces through the furnace is provided as the transportation device. For hanging transportation, the hangers should be arranged so that the front end of a workpiece can protrude from the furnace while the rest still remains inside the furnace.

Preferably, at least the cover 13 on the exit opening of the furnace 10 can be opened in varying degrees of opening. The cover 13, for example, can be controlled by a drive so that it opens the exit opening completely or only partly. The covers can then only be opened as far as is necessary which prevents unnecessary loss of heat.

Suitable heating facilities 11 are arranged inside the furnace with which the workpieces 20 can be heated while travelling through the furnace on the transportation device. Such state of the art heating facilities are known and are not described in detail. Also any other components required for the operation of the furnace are not the subject of the invention and can be chosen by an expert as appropriate.

Figure 2:
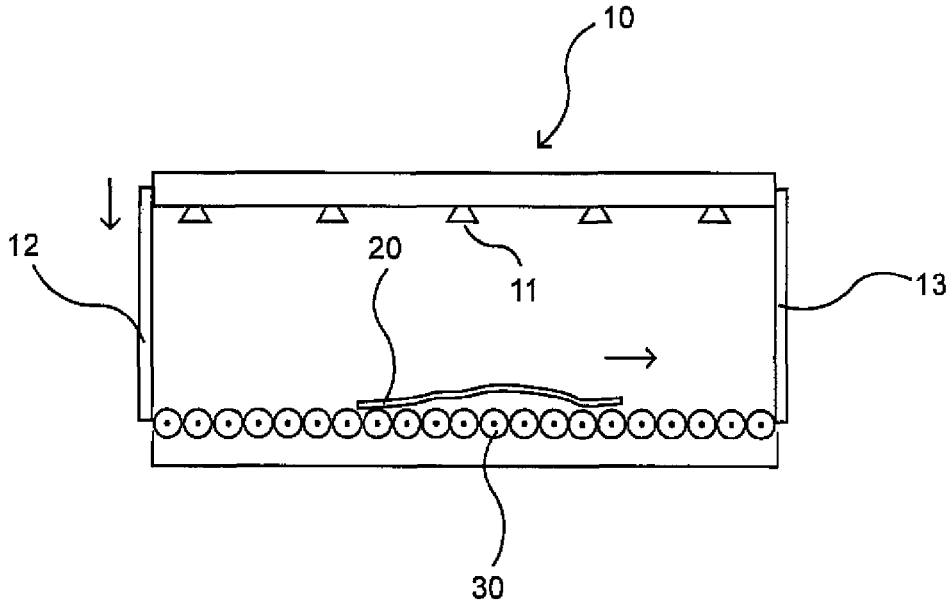
FIG. 2 is a cut-away view of a furnace showing the process step of heating the entire workpiece inside a heating zone in accordance with an exemplary embodiment of the present invention.

The individual process steps of the process according to an exemplary embodiment of the present invention and further embodiment options will now be illustrated in the following figures. As is evident from FIG. 1, the cover 12 of the entry opening opens and a workpiece 20 is moved into the furnace 10 by the transportation device 30. In FIG. 2, the cover 12 is already closed again and the workpiece 20 moves on the transportation device 30 through the heating zone of the furnace which is formed by the heating facilities 11. The workpiece 20 is thereby heated to a temperature which is suitably below the hardening temperature of the material of the workpiece 20. If the hardening temperature of the workpiece is, for example, ca. 700° C., then the heating facilities 11 and the throughput time of the front edge of the workpiece 20 through the heating zone is selected so that the workpiece 20 is heated to a temperature of 700° C.

The length of the furnace 10 and the speed of transportation of the transportation device 30 are thereby suitably correspondingly selected so that the workpiece is moved continuously through the furnace and the desired temperature is achieved in the workpiece as soon as the front edge of the workpiece 20 has completely traveled through the heating zone to the end of the furnace. Alternatively, it can also be provided to shortly interrupt the movement of the transportation device time in order to keep the workpiece inside the heating zone for a predetermined time period.

Figure 3:
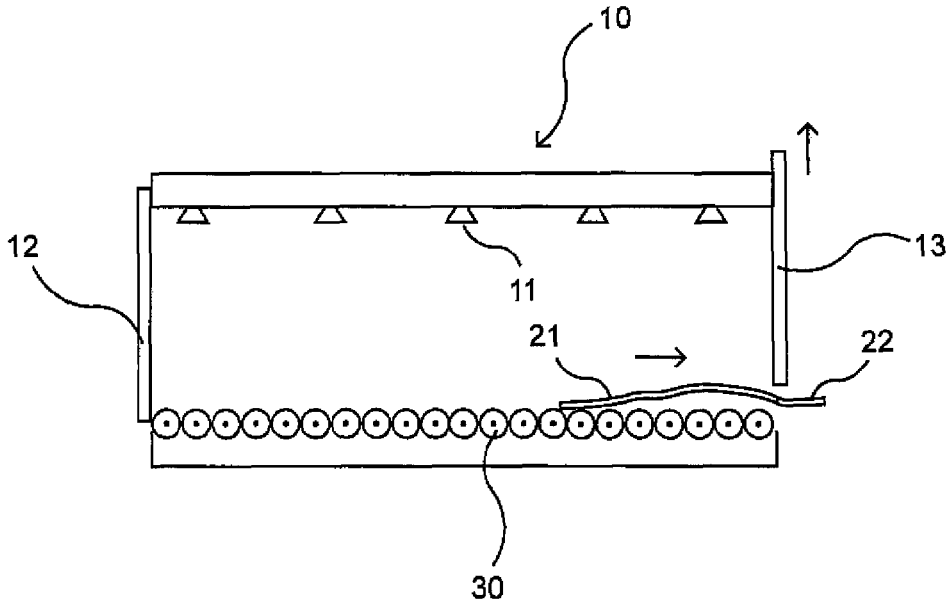
FIG. 3 is a cut-away view of a furnace showing the process step of partly moving a workpiece out of a continuous furnace in accordance with an exemplary embodiment of the present invention.

Subsequently, the cover 13 opens the exit opening of the furnace 10 so that a part of the workpiece can be moved out of the furnace. The cover 13 does not need to be opened completely but can, for example, just open the lower portion of the exit opening as illustrated in FIG. 3. As soon as this portion 22 of the workpiece 20 is outside the furnace and therefore outside the heating zone, the movement of the transportation device 30 is interrupted for a specified time period. Outside the furnace 10, holding devices can be provided to support the workpiece 20.

During the time period in which the transportation device 30 stands still, the first portion 21 of the workpiece 20 which is still inside the furnace and therefore in the zone of the heating facilities 11 is further heated to a temperature which at least corresponds to the hardening temperature of the material of the workpiece. For example, this portion 21 is heated to a temperature above 700° C. while the second portion 22 of the workpiece outside the furnace is no longer heated. Both portions therefore develop different temperatures due to the different times of residence of the portions in the furnace.

Depending on the surrounding conditions outside the furnace 10, the second portion 22 outside the furnace 10 cools down somewhat so that it has to be previously heated in the furnace to a temperature which despite slight cooling at the end of the process is at a temperature $T_1$ at which the structure in the material is only partly changed so that at subsequent rapid quenching this portion remains comparatively ductile. In the first portion 21 however, the longer heating inside the heating zone results in a higher temperature $T_2$ which results in a complete change of structure and therefore austenitizing. At subsequent quenching, this first portion therefore develops higher strengths. Principally, however, a complete change of structure does not have to occur in this portion either. The temperature and therefore the measure of structural change should just be higher than in the second portion 21 in order to achieve the desired differences in material properties.

Figure 4:
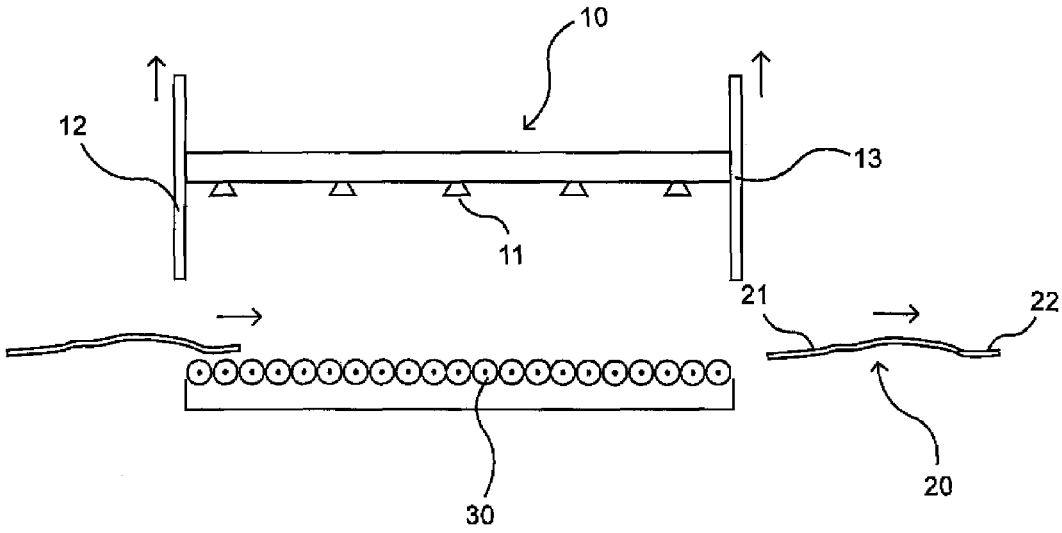
FIG. 4 is a cut-away view of a furnace showing a workpiece after carrying out the process according to an exemplary embodiment of the present invention and introduction of a new workpiece.

As soon as at least the desired temperature $T_2$ is achieved in the first portion 21, the workpiece 20 can be removed from the furnace as illustrated in FIG. 4. The cover 13 can also be raised further in order to increase the degree of opening so that the workpiece 20 can be removed completely. The workpiece is now outside the furnace 10 with the desired temperatures $T_1$ and $T_2$ and can be subjected to further process steps. It can, for example, be moved either manually or by robotics into a quenching bath or a forming press.

In a further exemplary embodiment of the invention, the entire workpiece is heated in the furnace to a temperature corresponding to the hardening temperature of the material in question. As soon as the second portion 22 of the workpiece is outside the heating zone, it cools down to a temperature below the hardening temperature while the first portion 21 of the workpiece inside the furnace is still kept at hardening temperature. This also results in the two portions having different temperatures.

Figure 5:
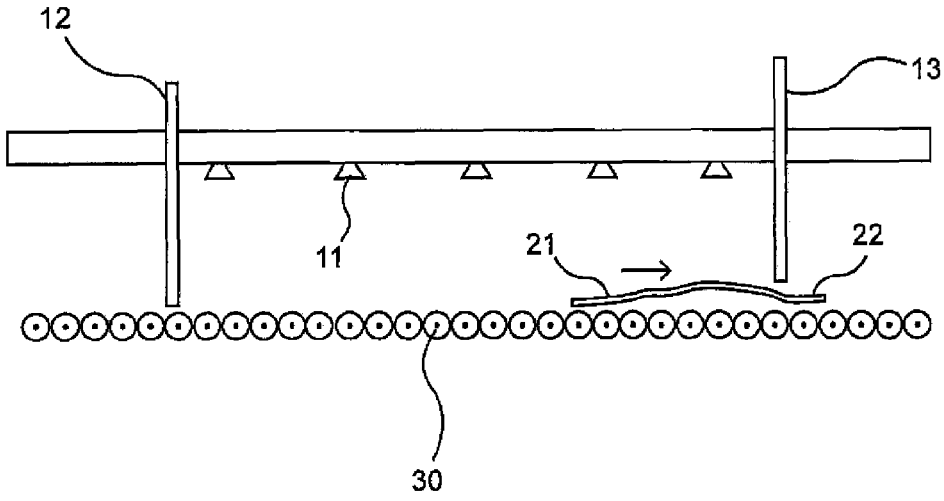
FIG. 5 is a cut-away view of a furnace showing a second exemplary embodiment of a continuous furnace.

Alternatively to a closed continuous furnace with housing, the process according to an exemplary embodiment of the present invention can also be carried out with a transportation device 30, which just moves the workpieces through a heating zone enclosed in a housing in which the heating facilities are arranged. This is illustrated for example in FIG. 5. In this case, this is not a closed furnace but is just a zone of the heating zone as defined by separator slides 12 and 13 in which heating by heating facilities 11 occurs on the transportation device 30.

The cycle times of the covers in question 12 and 13 are adjusted to the time of residence of the workpiece 20 in the furnace, to the speed of the transportation device 30 and also to the standstill period of the transportation device 30. Also the varying degrees of opening, in particular of the cover 13 at the exit opening, are also adjusted to the steps in the process according to an exemplary embodiment of the present invention. Therefore, for example, the cover 13 of the exit opening of the furnace 10 opens and subsequently the movement of the transportation device 30 is interrupted. Afterwards, the cover 13 can, if required, be lowered again slightly. The cover 13 must, however, open again before the transportation device 30 and therefore the workpiece resume movement. Simultaneously, the cover 12 can open the entry opening in order to accept another workpiece. With this process flow, cycle times of 15 seconds can be achieved for the heating of workpieces.

Figure 6:
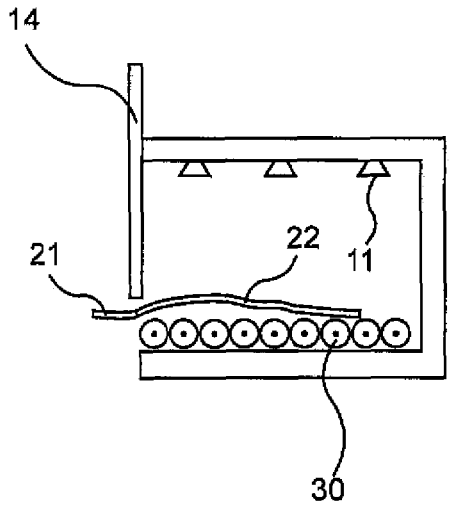
FIG. 6 is a cut-away view of a furnace showing a third exemplary embodiment of a continuous furnace.

In an exemplary embodiment of the invention, a continuous furnace is not provided to heat workpieces but, instead, a furnace just equipped with an opening through which workpieces are introduced and removed again. This furnace construction is illustrated schematically in FIG. 6. A workpiece is placed in the furnace 10 and moved, if necessary, with a transportation device 30 into the inside of the furnace. After the workpiece 20 is so heated to a temperature below the hardening temperature of the material of the workpiece, the cover 14 opens the furnace opening at least partly and the workpiece 20 is moved so far out of the furnace so that a first portion 21 is still inside the furnace while a second portion 22 is outside the furnace. The workpiece is kept at this position until the first portion 21 is further heated to the desired temperature. Subsequently, the workpiece 20 is removed completely from the furnace and the next workpiece can be treated.

Figure 7:
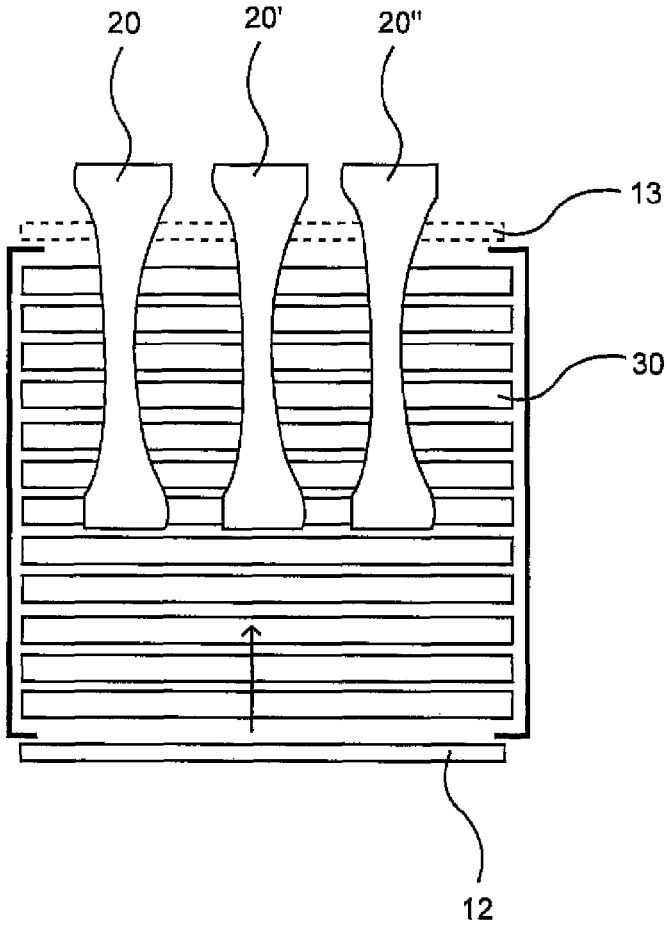
FIG. 7 is a schematic top view of several workpieces in a continuous furnace according to an exemplary embodiment of the present invention.

Obviously, not just one workpiece can be heated with the process according to the invention but several workpieces can be simultaneously treated. This is illustrated as an example in FIG. 7 in a schematic top view. Three workpieces 20, 20' and 20" are thereby moved next to each other on a transportation device 30 through a furnace. At the end of the furnace, portions of all the workpieces also protrude from the furnace in order to further heat the other portions in question of the workpieces inside the furnace. It is further possible to move one or several workpieces through the furnace on a piece carrier.

If several workpieces are moved simultaneously through a continuous furnace, it can be provided in an exemplary embodiment according to the invention that the movement of individual workpieces is temporarily interrupted in order to adjust the output of the furnace to the capacities of downstream stations. This is described below as illustrated in FIGS. 8-14.

Figure 8:
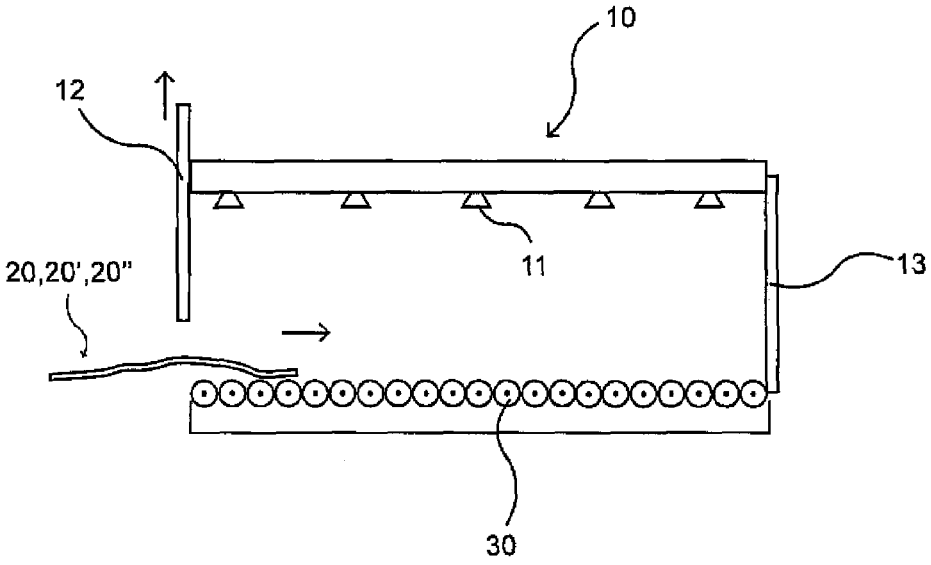
FIG. 8 is a cut-away view of a furnace showing the process step of introducing several workpieces into a continuous furnace according to an exemplary embodiment of the present invention.

As is evident from FIG. 8, the workpieces are placed on the roller conveyor 30 and moved next to each other simultaneously by the driven rollers through the continuous furnace 10. For this exemplary embodiment of the invention also, any other transportation facilities can be provided. Further, a separate transportation device can be provided for each workpiece and the movements of these transportation facilities are separately controllable. For example, a number of roller conveyors can be arranged next to each other whereby one workpiece respectively is placed on each roller conveyor.

Figure 9:
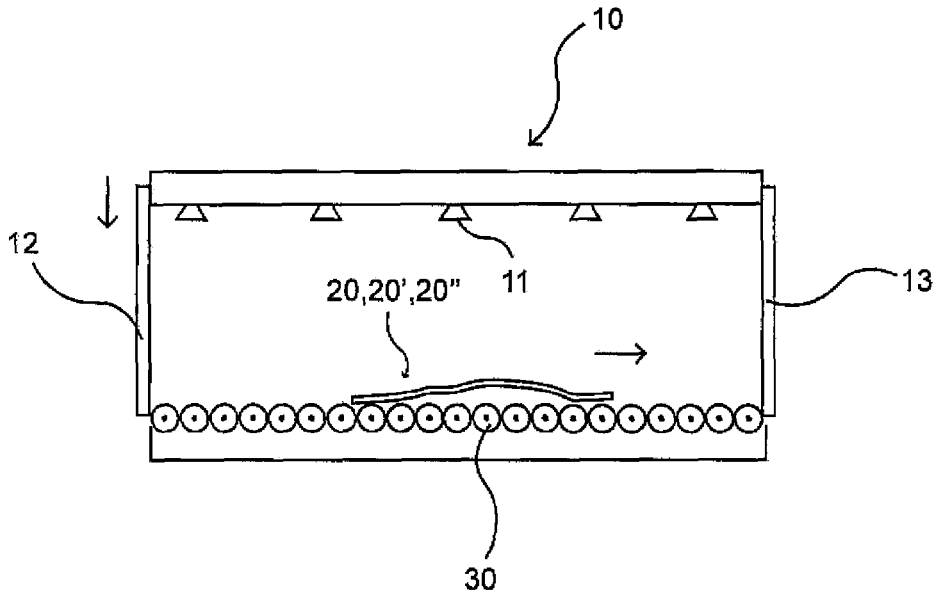
FIG. 9 is a cut-away view of a furnace showing the process step of simultaneously heating several workpieces within a heating zone according to an exemplary embodiment of the present invention.

In FIG. 9, the cover 12 is already closed again and the workpieces 20, 20' and 20" move simultaneously on the transportation device 30 through the heating zone of the furnace which is formed by the heating facilities 11. The workpieces 20, 20' and 20" are thereby heated to a temperature which is below the hardening temperature of the material of the workpiece 20. If the hardening temperature of the workpiece is for example ca. 700° C., then the heating material 11 and the throughput time of the front edges of the workpieces 20, 20' and 20" through the heating zone are selected so that the workpieces 20, 20' and 2" are heated to a temperature below 700° C.

Figure 10:
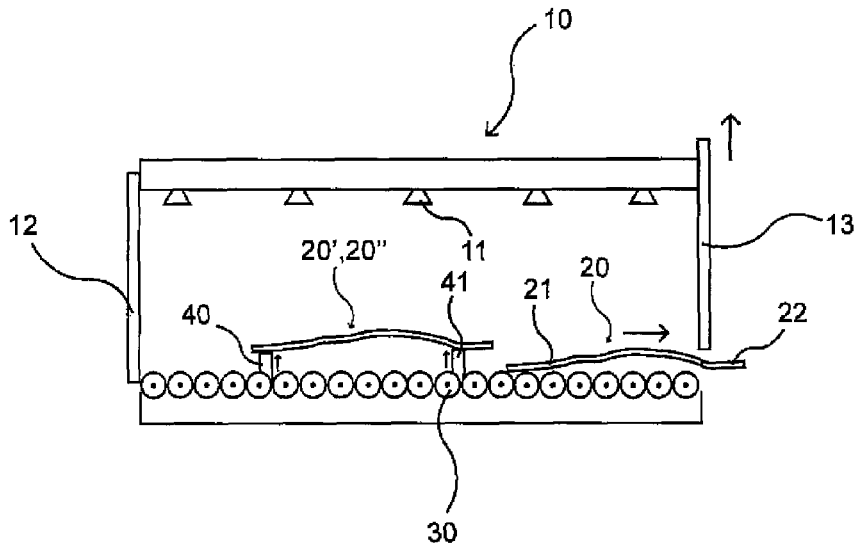
FIG. 10 is a cut-away view of a furnace showing the process step of partly moving a workpiece out of a continuous furnace and the disconnection of at least one workpiece from a transportation device according to an exemplary embodiment of the present invention.

After this common heating of the workpieces 20, 20' and 20", the transportation movement of at least one of the workpieces is temporarily interrupted. If a separate transportation device is used for each workpiece, this can be achieved easily by temporarily interrupting the movement of the transportation device in question. If a common transportation device is used for all workpieces, a temporary interruption of the transportation movement of individual workpieces can be achieved by temporarily disconnecting the workpiece in question from the transportation device. Depending on the embodiment of the transportation device, disconnection can be realized in different ways. FIG. 10, for example, illustrates how two of the workpieces 20' and 20" are temporarily disconnected from the transportation device 30 in that they are lifted by the push rods 40 and 41 so they no longer have any contact to the transportation device 30. For other types of transportation device other than a roller conveyor, disconnection can be achieved for example by unhooking workpieces from the transportation device in which they were previously suspended.

The push rods 40 and 41 are beneath the workpieces and perform upward and downward movement in cycle time which is controlled by a control device. The push rods can thereby be guided through spaces between the individual rollers of the roller conveyor and thus lift and then lower one or more workpieces in cycle time. In the exemplary embodiment illustrated in FIG. 3, two workpieces 20' and 20" are disconnected in this way from the roller conveyor while a remaining workpiece 20 is moved further. However, the invention is not limited to this embodiment but instead, for example, two workpieces can be moved further on while only one workpiece is disconnected or other variations are possible for another number of workpieces.

Subsequently, the cover 13 opens the exit opening of the furnace 10 so that a part of the workpiece 20 that was further moved can be moved out of the furnace. As soon as this portion 22 of the workpiece 20 is outside the furnace and therefore outside the heating zone, the movement of the transportation device 30 is interrupted for a specified time period of, for example, 15-25 seconds for this workpiece 20.

Figure 11:
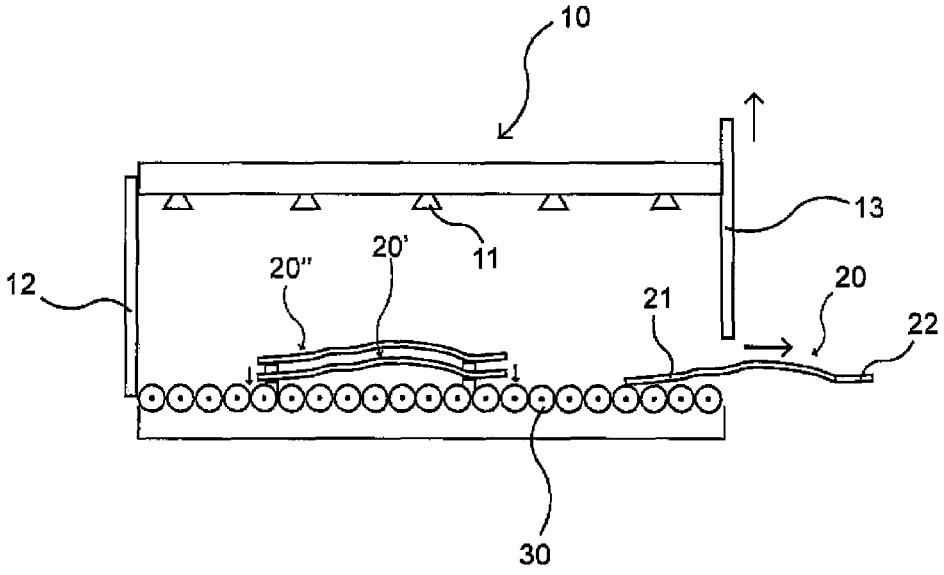
FIG. 11 is a cut-away view of a furnace showing a first workpiece after heating and the connection of a further workpiece back to the transportation device according to an exemplary embodiment of the present invention.

As soon as at least the desired temperature $T_2$ is achieved in the first portion 21, the workpiece 20 can be removed from the furnace as illustrated in FIG. 11. Subsequently or even while the first workpiece 20 is being moved out of the furnace, the transportation movement of at least one of the remaining workpieces 20' is resumed. In the exemplary embodiment in FIG. 11, the workpiece in question 20' is again connected to the transportation device 30 in that the corresponding push rods move downward and again place the workpiece on the transportation device 30 which conveys it to the furnace exit.

Figure 12:
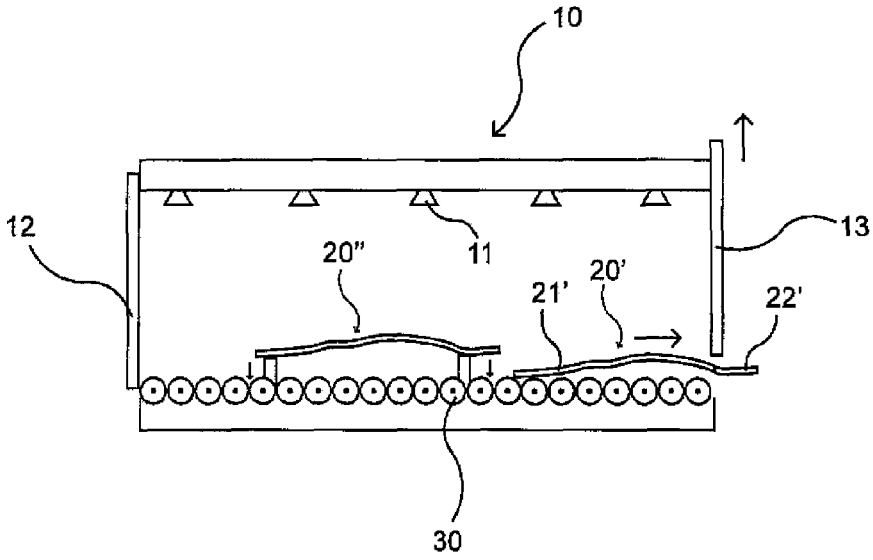
FIG. 12 is a cut-away view of a furnace showing a second workpiece after heating and the connection of a further workpiece back to the transportation device according to an exemplary embodiment of the present invention.
Figure 13:
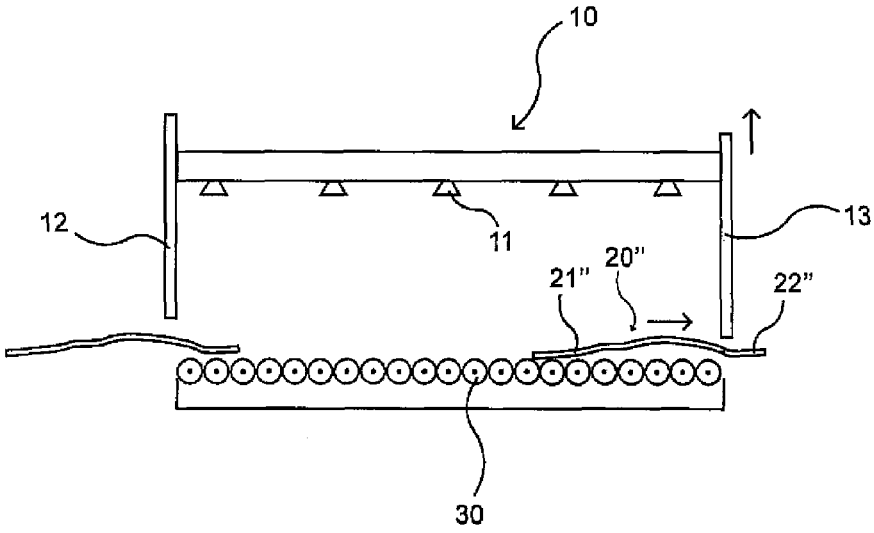
FIG. 13 is a cut-away view of a furnace showing a third workpiece after heating and the introduction of new workpieces into the furnace according to an exemplary embodiment of the present invention.

For this workpiece 20', the described steps for the partial continuation of heating are repeated while the remaining workpiece 20' remains disconnected from the transportation device 30 as illustrated in FIG. 12. If the workpiece 20' is removed from the furnace, the push rods of the workpiece 20" are also lowered and partial continuation of heating at the end of the furnace 20 can also take place for this workpiece 20". At this point in time, new workpieces can already be introduced into the furnace through the entry opening as illustrated in FIG. 13 so that the described process steps are repeated.

The cycle times of the covers in question 12 and 13 are adjusted to the residing time of the workpiece 20 in the furnace, to the speed of the transportation device 30 and also to the time period of the standstill of the transportation device 30. The upward and downward movement of the push rods is also adjusted to these parameters whereby the control of all components is preferably be achieved by a common control device.

Figure 14:
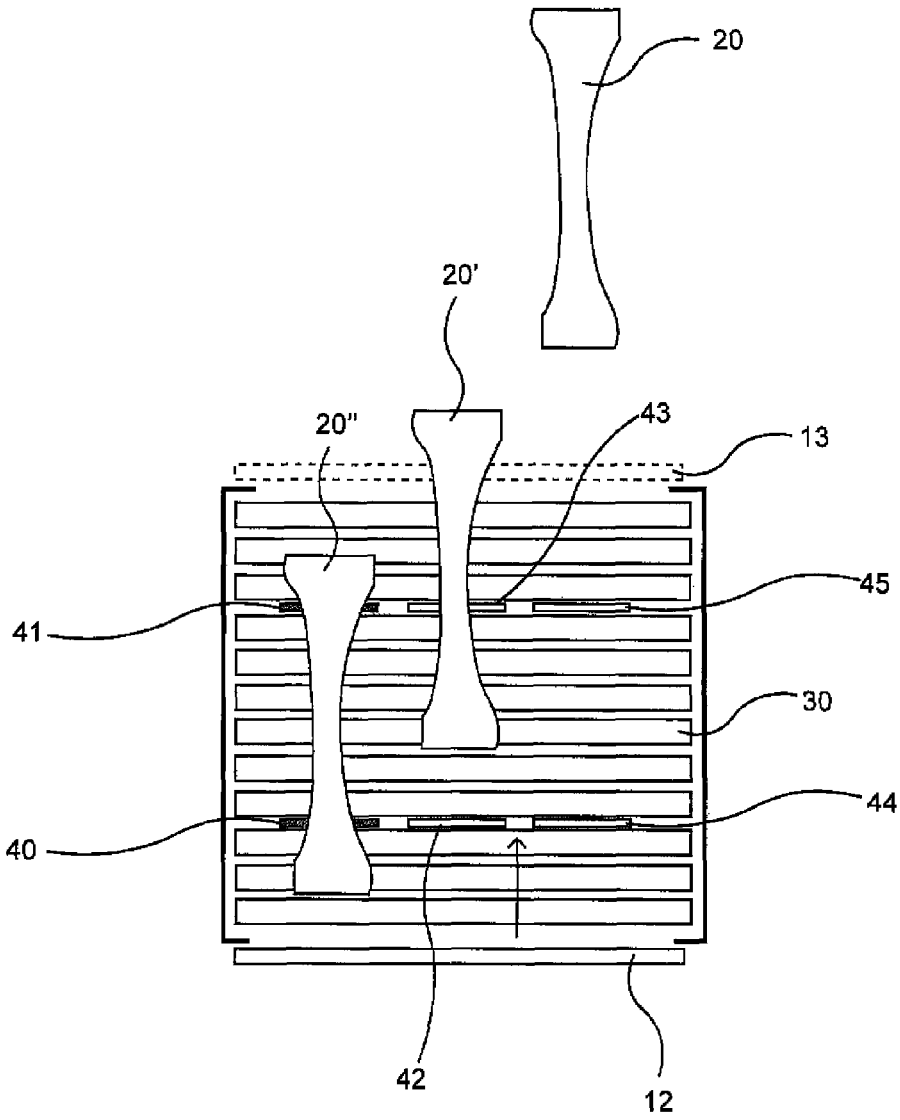
FIG. 14 is a schematic top view of several workpieces in a continuous furnace according to an exemplary embodiment of the present invention.

In a top view, FIG. 14 illustrates how three workpieces 20, 20' and 20" are heated by the furnace. Previously, the workpieces were placed next to each other on the roller conveyor 30 and moved through the furnace so that they were above push rods 40, 41, 42, 43, 44 and 45 whereby two push rods each, for example, which can lift and lower one workpiece at two points are provided for the disconnection of each workpiece. The push rods are arranged in spaces between the individual rollers of the roller conveyor so that they can be moved out between the rollers. FIG. 14 depicts the activated push rods 40 and 41 in solid black whereby these activated push rods have lifted the workpiece 20" and therefore disconnected it from the movement of the roller conveyor 30. In contrast, the currently deactivated push rods 42, 43, 44 and 45 are shown in white. This applies to the corresponding push rods of the workpiece 20 which was already removed from the furnace and for the corresponding push rods 42 and 43 of the workpiece 20' which is currently undergoing a partial resumption of the heating at the end of the furnace. In order to achieve the cycle times of the individual push rods, sensors can be provided inside the furnace which determine the position of the workpieces on the transportation device 30 and transfer this data to a control device which carries out suitably adjusted control of the upward and downward movement of the push rods. The push rods can be designed in differing ways in order to be able to lift and lower the workpieces safely.

List of Reference Numerals

10 Furnace, continuous furnace
11 Heating facilities
12 Cover entry opening; separator slide
13 Cover exit opening; separator slide
14 Cover
20,20',20" Workpiece
21,21',21" First portion of a workpiece with higher temperature
22,22',22" Second portion of a workpiece with lower temperature
30 Transportation device, roller conveyor
40,41 Push rod (activated)
42,43,44,45 Push rod (deactivated)

The invention claimed is:

1. A method for heating at least one workpiece in a furnace by which the workpiece is heated by heating facilities, the method comprising:

heating a complete workpiece with the heating facilities;

moving the workpiece out of the furnace into a position in which a first portion of the workpiece is still inside the furnace while a second portion of the workpiece is outside the furnace;

holding the workpiece at the position for a predetermined time period; and moving the complete workpiece out of the furnace, wherein the first portion of the workpiece is heated to a temperature T1 which is below a hardening temperature of material of the workpiece while the second portion of the workpiece is heated to a temperature T2 which corresponds to the hardening temperature of the material of the workpiece.

2. The method recited in claim 1, wherein the furnace comprises a continuous furnace, the method comprising:

moving the workpiece through the continuous furnace using a transportation device so that a front side in a direction of travel of the workpiece is heated in a heating zone by the heating facilities;

moving the workpiece out of the heating zone of the continuous furnace such that the first portion of the workpiece is still inside the heating zone while the second portion of the workpiece is already outside the heating zone;

interrupting the movement of the transportation device for the predetermined time period; and moving the complete workpiece out of the heating zone of the continuous furnace.

3. The method recited in claim 2, wherein, when the front side in the direction of travel of the workpiece has travelled through the heating zone of the continuous furnace, the complete workpiece is heated to a temperature which is below the hardening temperature of the material of the workpiece and the second portion of the workpiece inside the heating zone is further heated to a temperature T2 which corresponds to the hardening temperature of the material of the workpiece when the first portion of the workpiece is outside the heating zone.

4. The method recited in claim 1, comprising:

moving the workpiece through an entry opening in a continuous furnace after a cover has temporarily opened the entry opening;

moving the workpiece through an exit opening out of the continuous furnace after the cover has temporarily opened the exit opening;

after the opening of the exit opening, moving the workpiece out of the continuous furnace such that a first portion of the workpiece is inside the continuous furnace while a second portion of the workpiece is outside the continuous furnace; and adjusting cycle times of the covers of the entry and exit opening to cycle times of a transportation device that moves the workpiece through the continuous furnace.

5. The method recited in claim 4, comprising:

partly opening the cover of the exit opening to move the second portion of the workpiece out of the continuous furnace;

subsequently opening the cover of the exit opening more to allow the workpiece to be moved completely out of the continuous furnace; and adjusting the varying degrees of opening of the cover of the exit opening to the cycle times of the transportation device.

6. The method recited in claim 1, wherein at least two workpieces are moved next to each other simultaneously by a transportation device through the furnace such that the at least two workpieces are heated in a heating zone by the heating facilities.

7. The method recited in claim 6, comprising:

moving front sides in the direction of travel of the at least two workpieces through the heating zone of the furnace either partly or completely;

interrupting the movement of at least a first workpiece while at least a second workpiece is moved out of the heating zone of the furnace such that a first portion of the at least the second workpiece is still inside the heating zone while a second portion of the at least the second workpiece is already outside the heating zone;

interrupting the movement at this position of the at least the second workpiece for a predetermined time period;

moving the at least the second workpiece out of the heating zone of the furnace;

resuming the movement of the at least the first workpiece and the movement of the at least the second workpiece so far out of the heating zone of the furnace such that a first portion of the at least the first workpiece is still inside the heating zone while a second portion of the at least the first workpiece is already outside the heating zone;

interrupting the movement at this position of the at least the first workpiece for a predetermined time period; and moving the at least the first workpiece out of the heating zone of the furnace.

8. The method recited in claim 7, wherein each of the workpieces is moved through the furnace by a separate transportation device and wherein the interruption of the transportation movement of the at least the first workpiece is achieved by interrupting the movement of the corresponding transportation device while the resumption of the transportation movement of the at least the first workpiece is achieved by resumption of the movement of the corresponding transportation device.

9. The method recited in claim 7, wherein all workpieces are moved through the furnace using a common transportation device and wherein the interruption of the movement of the at least the first workpiece is achieved by disconnection of the at least the first workpiece from the transportation device while the resumption of the movement of the at least the first workpiece is achieved by connection of the at least the first workpiece to the transportation device.

10. The method recited in claim 9, wherein the transportation device comprises a roller conveyor on which the workpieces are moved next to each other simultaneously through the heating zone of the furnace and wherein that the disconnection of the at least the first workpiece from the roller conveyor is achieved by lifting the workpiece to a position in which the workpiece does not have any contact with the roller conveyor while the connection of the at least the first workpiece to the roller conveyor is achieved by lowering the workpiece to a position in which the workpiece again has contact with the roller conveyor and is moved by the same in the direction of travel.

11. The method recited in claim 10, wherein the lifting and lowering of the at least the first workpiece is achieved by one or more push rods that are arranged beneath the at least the first workpiece and are adapted to move upward and downward in cycle time whereby the upward movement of at least one push rod results in the lifting of the at least the first workpiece from below while the downward movement of the at least one push rod results in the lowering of the at least the first workpiece.

* * * * *